United States Patent [19]

Inoi et al.

[11] 3,958,435

[45] May 25, 1976

[54] METHOD FOR CONTROLLING THE PROFILE OF WORKPIECES ON ROLLING MILLS

[75] Inventors: Yoshio Inoi; Takeyuki Fukuda; Kouji Hyoudou, all of Sakai; Atsuhiro Wakako, Handa, all of Japan

[73] Assignee: Nippon Steel Corporation, Tokyo, Japan

[22] Filed: May 28, 1975

[21] Appl. No.: 581,655

[30] Foreign Application Priority Data.

June 1, 1974 Japan ..... 49-62289

[52] U.S. Cl. ..... 72/9; 72/13

[51] Int. Cl.[2] ..... B21B 37/00; B21B 37/02; B21B 37/10

[58] Field of Search ..... 72/9, 13, 19, 6

[56] References Cited

UNITED STATES PATENTS 3,714,805 2/1973 Stone ..... 72/8

3,882,709 5/1975 Kawamoto et al. ..... 72/6 X

*Primary Examiner*—Milton S. Mehr

*Attorney, Agent, or Firm*—Lane, Aitken, Dunner & Ziems

[57] ABSTRACT

There is described a method for controlling the profile of a workpiece on a rolling mill, wherein the workpiece is imparted with a predetermined profile in the roughing stage which is suitable for further control in the following finishing stage. In the finishing stage, the desired profile of the workpiece is attained by controlling the temperature of the workpiece at inlet position of the second finishing stage and/or controlling the thickness of the workpiece at outlet position of the first roughing stage. To determine the temperature and/or the thickness of the workpiece at inlet position of the second finishing stage a crown model formula is utilized. The crown model formula includes some constants, and variables which represent the mean temperature of the workpiece in the second finishing stage, and the thickness of the workpiece at the outlet of the first roughing stage.

5 Claims, 6 Drawing Figures

FIG. 4
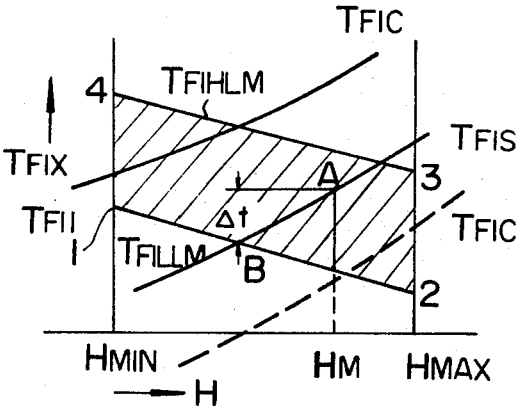
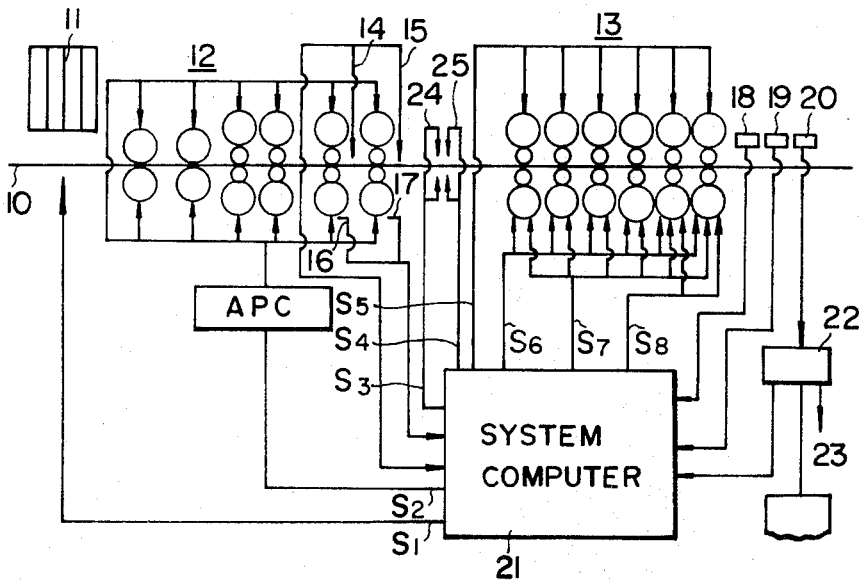
FIG. 5

METHOD FOR CONTROLLING THE PROFILE OF WORKPIECES ON ROLLING MILLS

BACKGROUND OF THE INVENTION

The present invention relates to a method for controlling the profile of a plate workpiece being rolled on a hot rolling mill in a finishing stage.

For controlling the profile of a workpiece on a practical rolling mill, a coil obtained posterior to a take-up process is partly cut off to measure the profile of the product workpiece, and in accordance with the actual value thus measured, an operator carries out adjustment of a rolling pitch (attained principally by delaying the rolling pitch), adjustment of the workpiece thickness in the roughing stage, adjustment of the rolling load distribution in the finishing stage, adjustment of the pressure (with respect to wedge and crown) on both the driving side and working side of the rolling mill, adjustment of the workpiece temperature by controlling a delay time on a delay table, modification of the initial curve of the mill rollers, intermediate rearrangement of the mill rollers, and adjustment of the quantity of cooling water for the finishing mill rollers, thereby controlling the profile of the workpiece on the rolling mill to desired dimensions. However, since such actual measurement of the profile is carried out in an off-line manner posterior to take-up of the workpiece, it requires a relatively long time. Besides that, profile producing factors are so complicated and are liable to cause great undesirable effects due to secular changes including thermal crown and abrasive wear of the rollers, so that the rolling conditions are not readily maintained constant to result in difficulties in attainment of accurate crown control. Moreover, the abovedescribed rolling pitch adjustment brings about a reduction in the rolling efficiency and also a great time delay in cooling or heating the rollers of the finishing rolling mill to render difficult the crown control for individual coils.

The inventions proposed heretofore in relation to profile control are principally of the type employing a roll bending system, in which the profile control allowance obtained by roll benders is so small that sufficient control is not achieved by the roll benders alone.

U.S. Pat. No. 3882709 to Kawamoto, Toshiharu et al. discloses a method for controlling the profile of workpieces on rolling mills, which comprises the steps of roughly adjusting the crown by means of a first roughing stage of the rolling mill to produce a profile on the workpiece which is within an allowable predetermined range for a successive second finishing stage of the rolling mill and finely adjusting the crown by means of said second finishing stage of the rolling mill to produce the desired profile on the workpiece by utilizing all but the final stand within said finishing stage.

In the method, the crown is controlled by adjusting the roll temperatures of the stands, the roll benders, the rolling pitches at the stands, and/or modifying the load distribution among the stands.

In the above invention, however, there still exist some disadvantages as observed in the foregoing prior arts, and preferably such disadvantages are to be eliminated.

SUMMARY OF THE INVENTION

The object of the present invention resides in providing a profile control method which is rapidly responsive and capable of effecting accurate profile control with improvement of a rolling efficiency.

Rapid and accurate measurement of the crown is accomplished by the use of an on-line profile meter during the motion of the workpiece. It is known that definite positive relationship exists between the crown value and the total finish rolling reaction force, of which one example is shown in FIG. 1. In the graph shown in FIG. 1, the total finish rolling reaction force (ton) is taken along the horizontal axis, and the crown value (micron) along the vertical axis. The ▲ marks denote the values obtained by changing the finishing-stage inlet temperature only; the marks ⊙denote those obtained by changing the load distribution only; and the marks ● denote those obtained by changing the final thickness of the workpiece of the first roughing stage only. As represented by the dotted, solid and chain lines respectively, the crown value increases substantially linearly in relation to an increase of the total finish rolling reaction force. It is possible, therefore, to control the crown value through control of the total finish rolling reaction force.

The total finish rolling reaction force F is adjustable by changing the finishing inlet temperature (workpiece temperature $T_{F1}$ at the inlet position of finish rolling mill) and the roughing outlet thickness (workpiece thickness H at the outlet position of rough rolling mill). The roughing outlet thickness and the workpiece temperature are related to each other in such a manner that an increase of the roughing outlet thickness H causes a rise of the finishing inlet temperature $T_{F1}$ provided that the temperature of the workpiece at inlet position of the first roughing stage is constant, thereby the profile of the workpiece at the outlet of the second finishing stage is kept substantially constant with the total finish rolling reaction force due to the increase of the roughing outlet thickness. That is, a rise of the finishing inlet temperature $T_{F1}$ causes a decrease of the total finish rolling reaction force F which is required to maintain constant the outlet thickness of the workpiece at the second finishing stage, thereby the finishing inlet temperature $T_{F1}$ causes such an effect that reduces the increase of the total finish rolling reaction force resulting from the increase of H. Thus, it is difficult to attain proper determination with respect to setting of the roughing outlet thickness H and the finishing inlet temperature $T_{F1}$.

In an attempt to separate these factors from one another, the present invention has adopted a finishing mean temperature serving as an index of the workpiece temperature in the finish rolling mill. The finishing mean temperature T used here denotes a mean value between the finishing inlet temperature $T_{F1}$ and the finishing outlet temperature $T_{FAIM}$ (which is so controlled as to coincide with a target value to obtain superior quality of the product workpieces). Namely, it is expressed as $T = (T_{F1} + T_{FAIM})/2$. Using the finishing mean temperature T, the total finish rolling reaction force F can be represented by an exponential function of the temperature T, as will be understood from the theory of plastic deformation.

FIG. 2 graphically shows the relationship between the roughing outlet thickness H and the total finish rolling reaction force F when converted to a finishing mean temperature of 900°C. Supposing now that the workpiece temperature between the inlet and outlet positions of the finishing stage are constant, namely the mean temperature of the second finishing stage is kept constant, then, as will be clear from the graph of FIG. 2, the total finish rolling reaction force F is represented substantially by a linear equation $F = a + bH$. FIG. 3 graphically shows the relationship between the finishing mean temperature T and the total finish rolling reaction force F when both the roughing outlet workpiece thickness and the predetermined product thickness are kept fixed (in this example, 25.6mm and 2.0mm respectively). This relationship is expressed as $$F = 463e^{\frac{2919}{273+T}}.$$

In another aspect, the crown C of the workpiece at the outlet position of the second finishing stage is expressed $C = KF$, namely the crown C is proportional to the total reaction force F. As stated hereinbefore, the total reaction force F can be expressed as $F = a + bH$ in which the mean temperature T is constant, and $$F = 463e^{\frac{2919}{273+T}}$$

in which the inlet thickness H is constant so that F can be expressed $F = f(H, T)$ in which H and T are variable. Therefore the crown C can be expressed as follows.

$$C = Kf(H, T) \qquad (0)$$

Using the relationships $$F = 463e^{\frac{2919}{273+T}}$$

wherein H is constant and $F = a + bH$ wherein T is constant, the formula (0) can be expressed as follows, provided that the mean velocity of the workpiece at the second finishing stage is constant.

$$C = K_1 e^{\frac{K_2}{T}} (K_3H + K_4) + K_5 \qquad (1)$$

wherein $K_1$: Constant determined by material and width of the workpiece $K_2$: Constant determined by material of workpiece $K_3$: Constant determined by thickness and material of product $K_4$: Constant corresponding to $a$ in the above equation $F = a + bH$ $K_5$: Constant determined by total reaction force, load distribution among the stands, initial curves of the rolls and adjustment, of the second finishing stage Here, the temperature T is indicated by (°K) for convenience. Since the crown C is expressed as Equation (1), if the roughing outlet thickness H is determined, a desired crown value is obtained by setting the finishing mean temperature T calculated out from the equation (1).

$$T = \frac{K_2}{\ln \frac{C - K_5}{K_1(K_3H + K_4)}} \qquad (2)$$

Also, since $T = (T_{F1} + T_{FAIM})/2$, the finishing inlet temperature $T_{F1}$ is expressed as $$T_{F1} = 2T - T_{FAIM} \qquad (3)$$

Wherein the $T_{FAIM}$ is the temperature of the workpiece at the outlet of the second finishing stage, and predetermined by the requirement upon the quality of the product. Therefore, the desired crown is attained by cooling, on a delay table, the workpiece being ejected from the rough rolling mill or by heating it by means of a heater, in such a manner that the temperature of the workpiece at the inlet of the second finishing stage coincides with the finishing inlet temperature calculated out from the equations (2) and (3).

When the thickness of the workpiece at the outlet of the first roughing stage were changed, target inlet temperature $T_{F1}$ can be calculated out to obtain desired constant crown C by using the equations (2) and (3).

Alternatively, if the temperature $T_{F1}$ can be controlled constant by using a heater means and/or cooling means, desired constant crown C of the product workpiece can be controlled by controlling the outlet thickness H of the workpiece at the first roughing stage by adjusting the first roughing stage, for example, by adjusting the rolling of the last stand of the first roughing rolling mill.

In addition, desired constant crown C of the product workpiece can also be obtained by adjusting both of the thickness H and temperature $T_{F1}$ by using the crown model formula (1).

In determination of the finishing inlet temperature $T_{F1}$ and/or thickness H of the workpiece at the outlet of the first roughing stage, it is necessary to take into consideration some other factors including a rolling speed at the second finishing stage, in addition to the conditions of Equation (1). FIG. 4 graphically illustrates how the finishing inlet temperature $T_{FIX}$ changes to meet the requirements in accordance with variations of the roughing outlet thickness H from its minimum $H_{MIN}$ to maximum $H_{MAX}$. First, the finishing inlet temperature required to maintain the desired crown rises as the roughing outlet thickness increases, as shown by the dotted and solid lines having a rightward-ascending curve. $T_{FIS}$ denotes the finishing inlet temperature at a standard condition when the workpiece is fed into the finish rolling mill without being heated or cooled while its thickness is within a range from $H_{MIN}$ to $H_{MAX}$. The dotted line $T_{FIC}$ (Case 1) and the solid line $T_{FIC}$ (Case 2) represents the characteristics obtained with execution of heating or cooling respectively. The upper and lower limits of a finish rolling speed are determined by the specifications, power and driving speed limits of the finishing rolling mill. When the rolling speed is at the upper or lower limit, the finishing inlet temperature $T_{F1HLM}$ or $T_{F1LLM}$ required for maintaining the finishing outlet temperature $T_{FAIM}$ may be low due to a temperature rise occurring during the rolling process in accordance with an increase of the workpiece thickness, so that the respective characteristic curves become rightward-descending as illustrated.

Thus, some relationship exists among the thickness H of the workpiece at the outlet of the first roughing stage, the running velocity V of the workpiece at the second finishing stage, the temperature $T_{F1}$ of the workpiece at the inlet of the second finishing stage and the temperature $T_{FAIM}$ of the workpiece at the outlet of the second finishing stage. Therefore the relationship can be expressed as $$T_{FAIM} = f(H, V, T_{F1}) \quad (4)$$

In any case, the final temperature $T_{FAIM}$ of the workpiece is determined constant to obtain superior quality of the product, in another words, H V and $T_F$ should be controlled to keep the $T_{FAIM}$ constant.

The crown model formula can be re-written as follows.

$$C = f(H, T) = f\left(H, \frac{T_{F1} + T_{FAIM}}{2}\right) \quad (5)$$

Upon the equation (4), (5), $T_{FAIM}$ and C should be constant, therefore variables are H, V and $T_{F1}$, and there are two equations (4) and (5).

Consequently, relationships among H, V and $T_{F1}$ can be expressed as follows, providing that C and $T_{FAIM}$ are kept constant.

$$V = f(H, T_{F1}) \quad (6)$$

$$H = f(V, T_{F1}) \quad (7)$$

$$T_{F1} = f(H, V) \quad (8)$$

Concrete stiles can be obtained upon (6), (7) and (8) by using the data expressed such as shown in FIG. 4. Those variables V, H and $T_{F1}$ has limitations which may be determined by rolling mill system employed.

Referring to the FIG. 4 again, practical determination of the finishing inlet temperature $T_{F1}$ is described hereinbelow.

In order to enable the finish rolling mill to operate at a rolling speed within its upper and lower limits when a bar of a roughing outlet thickness ranging from $H_{MIN}$ to $H_{MAX}$ is fed thereto while the finishing outlet temperature $T_{FAIM}$ is being maintained, it is necessary to hold the finishing inlet temperature $T_{F1}$ within the hatched region defined by the points 1 through 4. On the other hand, since the finishing inlet temperature $T_{FIC}$ required to maintain the desired crown has such characteristic as represented by the rightward-ascending curve illustrated, it should be within the hatched region for maintaining the desired crown and also satisfying the restrictive conditions received from the finish rolling mill.

Next, in case the finishing inlet temperature curve at the standard condition required for maintaining the desired crown is such as represented by $T_{FIS}$ in FIG. 4, if the roughing outlet thickness is set to $H_M$, the operating point is A with the finishing inlet temperature becoming $T_{FIA}$ and the rolling speed slightly shifting toward the minimum side. However, a production efficiency is reduced if the rolling speed is low. For maximizing the efficiency, therefore, cooling is carried out to lower the temperature by Δt down to point B on the curve $T_{F1LLM}$ that represents the temperature at the maximum rolling speed. Generally, when the roughing outlet thickness is small, a satisfactory result is obtained without surface chapping or the like caused by finishing rollers. In consideration of such relation, the most preferred operating point resides at 1 to attain the highest production efficiency and the least roller surface chapping. To aim at the maximal production quantity regardless of roll surface chapping, the operation point may be taken on the curve from 1 top 2. And to minimize the roller surface chapping at the sacrifice of production quantity, the point may be taken on the straight line from 1 to 4. Thus, from the graph of FIG. 4, it is possible to create the optimum operating state suited for various desired conditions.

When the actual measured value has a difference $\Delta h$ in comparison with the roughing outlet thickness used in the above-described method and there is also a difference ΔT between the calculated roughing outlet temperature and the actual measured value, then a target crown will be differed by ΔC from the predetermined target value, this ΔC can be expressed by the following equation.

$$\Delta C = Kh\Delta h + Kt\Delta T \quad (9)$$

Wherein K*h* and K*t* are constant. This error ΔC can be minimized by adjusting the thickness control and temperature $T_{F1}$ control. However, ΔC can be minimized by the use of adjustment $K_1 - K_5$ upon ΔC thus obtained so as to minimize the error ΔC. On the plate workpiece ejected from the finish rolling mill, the crown is measured by means of a profile meter, and after the entire or partial correction of the coefficients $K_1$ through $K_5$ of formula (1) in accordance with the difference between the estimated crown value and the actual measured crown value, learning control is carried out.

BRIEF DESCRIPTION OF THE DRAWINGS

FIG. 4 is a graphical representation of the relationship between the roughing outlet thickness and the finishing inlet temperature;

FIG. 5 is a block diagram of the composition of an equipment for carrying into effect the method of this invention.

DESCRIPTION OF THE PREFERRED EMBODIMENTS

Figure 1:
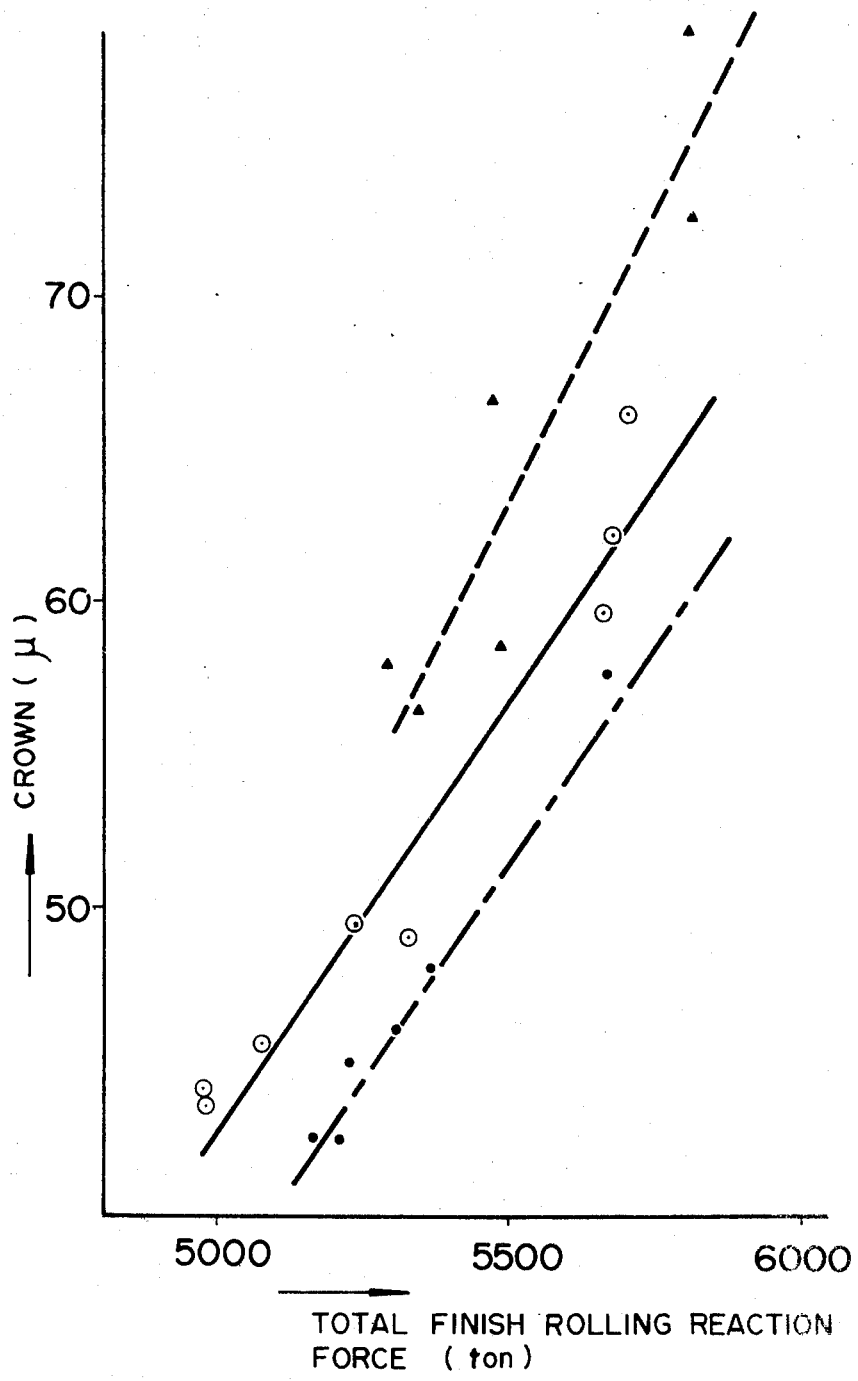
FIG. 1 is a graphical representation of the relationship between the total finish rolling reaction force and the crown value.
Figure 2:
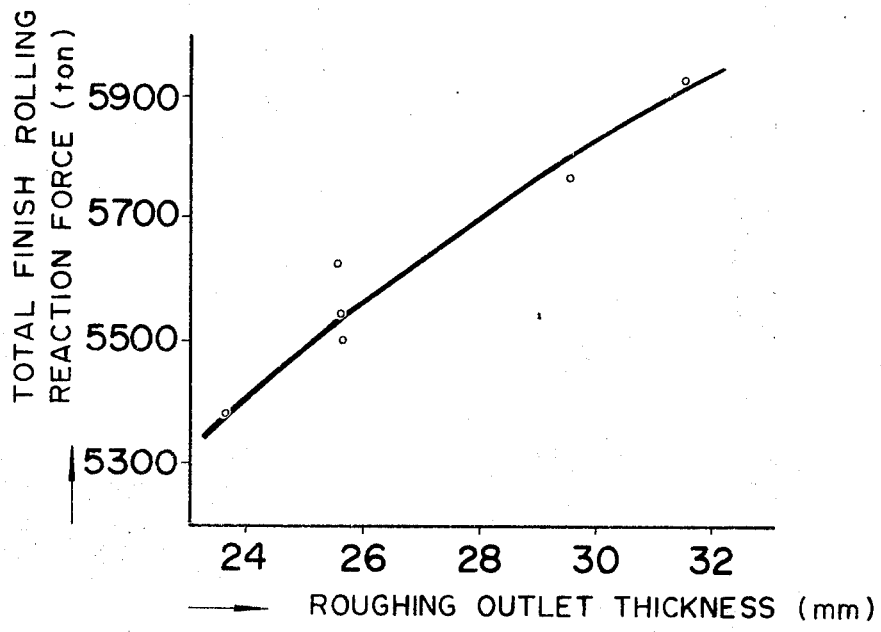
FIG. 2 is graphical representation of the relationship between the roughing outlet thickness and the total finish rolling reaction force.
Figure 3:
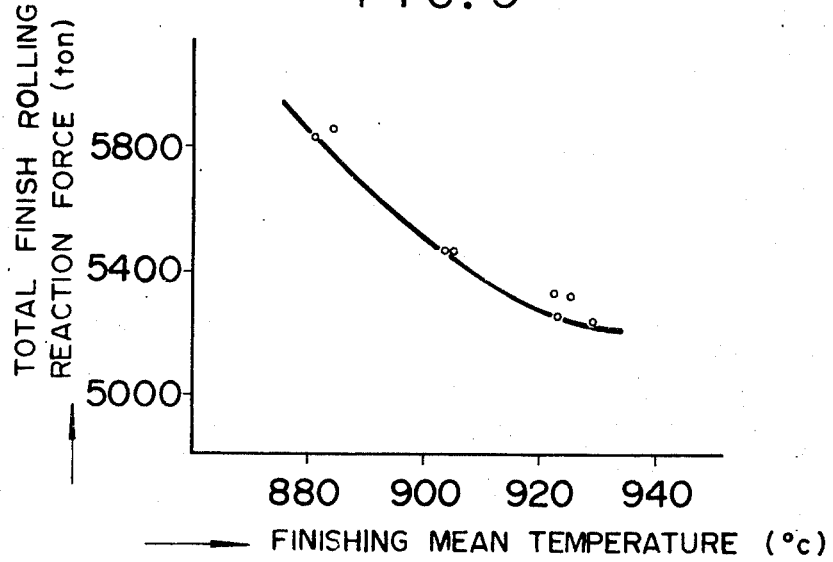
FIG. 3 is a graphical representation of the relationship between the finishing mean temperature and the total finish rolling reaction force.

FIG. 5 shows a preferred rolling equipment for carrying into effect the profile control method of the present invention, in which 10 is a workpiece to be rolled, 11 is a heating furnace, 12 is a rough rolling mill, and 13 is a finish rolling mill. The rear stage of the rough rolling mill 12 is provided with thermometers 14, 15 and load cells 16, 17, while the outlet side of the finish rolling mill 13 is provided with a thermometer 18, a shape detector 19 and a profile detector 20. The outputs of these components 14 through 19 are fed to a system computer 21. The output of the profile detector is fed to a data processing computer 22, whose output is fed to the system computer 21 and also to an alarm 23 and so on. Upon reception of the input signals, the system computer 21 sends a command $S_1$ to the heating furnace 11 for rolling pitch adjustment and sampling temperature adjustment, a command $S_2$ to a depressing position controller (APC) for depressing adjustment, commands $S_3$ and $S_4$ to an intermediate cooler 24 and an intermediate heater 25 for cooling water adjustment and heating oil adjustment, and further sends to the finish rolling miller 13 an oil quantity adjustment command $S_5$, a depressing adjustment command $S_6$, a roll cooling water adjustment command $S_7$ and a roll bender adjustment command $S_8$.

Figure 6:
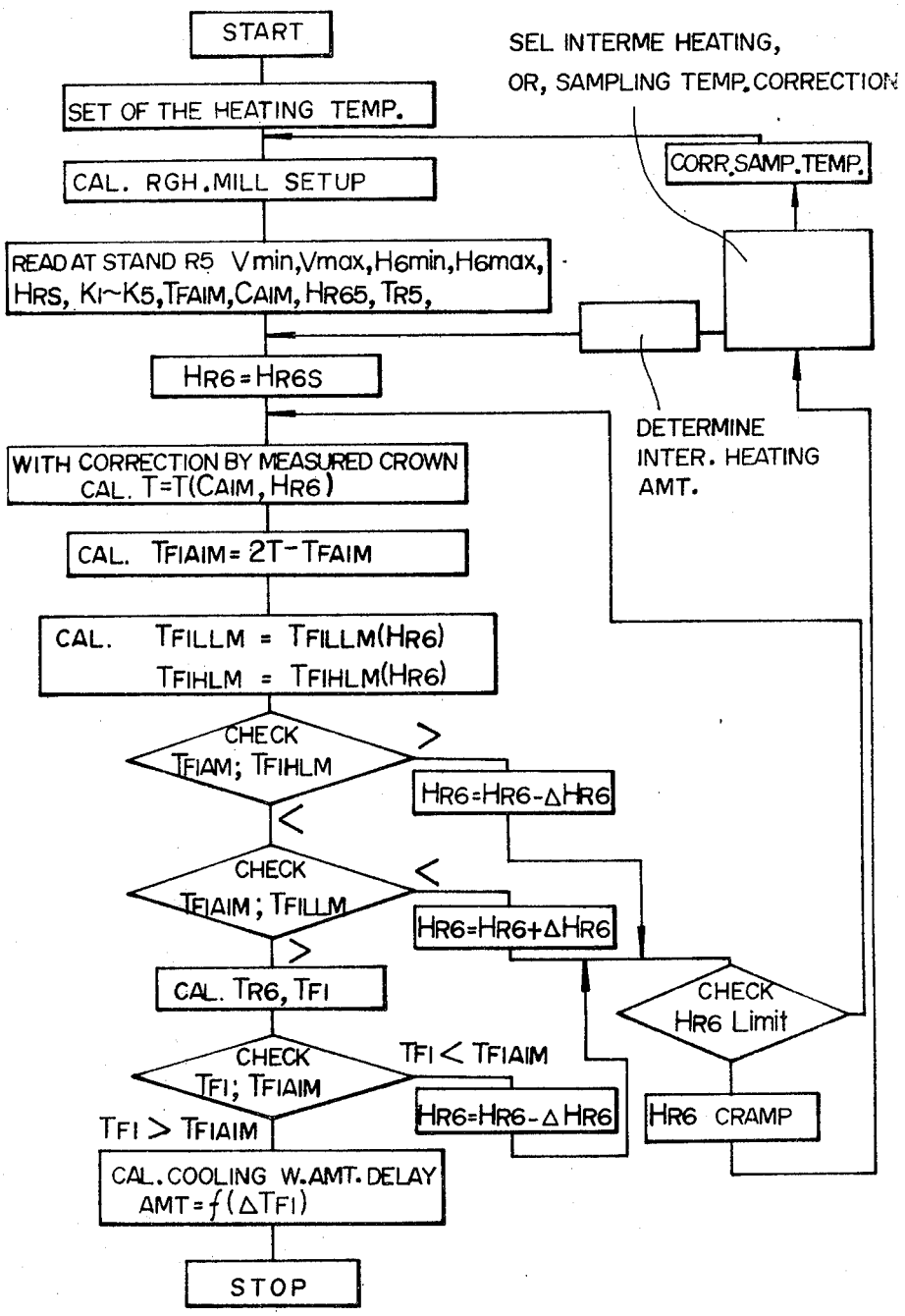
FIG. 6 is a flow chart explaining a computation sequence in the method of this invention.

The flow chart of FIG. 6 shows an example of computation processes performed by the system computer 21 and others. As plotted in this chart, first a heating sampling temperature is established by the use of a model, and after setting the rough rolling mill, reading or computation is executed, at the position of a stand $R_5$ located immediately anterior to the final roughing-stage stand, with respect to constants $K_1$ through $K_5$, finishing outlet target temperature $T_{FAIM}$, product target crown $C_{AIM}$, standard workpiece thickness $H_{R6S}$ at the final roughing stand outlet, workpiece thickness $H_{R5}$ and temperature $T_{R5}$ at the outlet of the stand located immediately anterior to the final roughing stand, maximum and minimum finish rolling speeds $V_{max}$ and $V_{min}$, and maximum and minimum roughing outlet workpiece thickness $H_{6min}$ and $H_{6max}$. Subsequently, regarding the roughing outlet thickness $H_{R6}$ as $H_{R6S}$, computation is started. First, the finishing mean temperature T is computed from Equations 1 and 2, and the finishing outlet temperature $T_{F1AIM}$ from 3 respectively. Then, minimum temperature $T_{F1LLM}$ and maximum temperature $T_{F1HLM}$ at the inlet position of the finish rolling mill to maintain the finishing oulet temperature are computed from a model used for establishing this outlet temperature.

Next, the finishing inlet workpiece temperature $T_{FAIM}$ for obtaining the target crown value is compared with the temperature $T_{F1HLM}$ when the finishing outlet temperature and the finishing inlet workpiece thickness are given, and in case the former is lower than the latter, the next check is carried out to discriminate whether $T_{FAIM}$ is higher or lower than $T_{F1LLM}$, and in case the former is higher than the latter, since execution of the desired rolling process is permitted, the final roughing stand outlet temperature $T_{R6}$ and the finishing inlet temperature $T_{F1}$ are computed. Then, a check is carried out to discriminate whether these are higher or lower than $T_{F1AIM}$, and in case $T_{F1}$ is higher than $T_{F1AIM}$, a required amount of cooling water or a delay amount on the delay table is computed, and cooling is performed on the basis of the result thus obtained, thereby executing the desired rolling process. In case $T_{F1AIM}$ is higher than $T_{F1HLM}$ or $T_{F1}$ is lower than $T_{F1AIM}$, the workpiece thickness $H_{R6}$ at the outlet of the final roughing stand is reduced by $\Delta H_{R6}$, and in case $T_{F1AIM}$ is lower than $T_{F1LLM}$, the workpiece thickness $H_{R6}$ is increased by $\Delta H_{R6}$. Subsequently, a check is carried out to discriminate whether these are within or beyond the predetermined limits of workpiece thickness $H_{R6}$. In the former case, recomputation is executed, while in the latter case, the workpiece thickness $H_{R6}$ is cramped, and then intermediate heating is used or the sampling temperature is corrected.

According to the profile control method of the present invention described hereinabove, it is possible to accomplish rapid correction of the profile and also to achieve accuracy in the correction through introduction of an estimate learning control model. As the result, in comparison with the conventional method, the present invention is capable of improving the mean crown value $\overline{X}$ with reduction of its scattering $\sigma$, as shown in the following table.

| Workpiece thickness (mm) | Conventional method | | This invention | |
|---|---|---|---|---|
| | $\overline{X}$ | $\sigma$ | $\overline{X}$ | $\sigma$ |
| $t < 2.0$ | 0.068 | 0.020 | 0.071 | 0.012 |
| $2.0 \leq t < 3.2$ | 0.080 | 0.025 | 0.087 | 0.016 |

At present, it seems that a precise and yet simple crown estimation model is not availale. However, the use of Equation (1) will render the crown estimation possible simply with a high precision to bring about enhancement of the crown control accuracy. And the resulting effects will serve well to reduce off-gauge products, thereby improving an yield rate.

Since certain changes may be made in the abovedescribed workpiece profile control method without departing from the scope of the invention as defined by the appended claims, it is intended that all matter contained in the above description should be interpreted as illustrative and not in a limiting sense.

What is claimed is

1. A method of controlling the profile of a workpiece passing through a rolling mill having a first roughing stage and second finishing stage comprising: establishing, with respect to the second finishing stage, a crown model formula including variables which correspond to a workpiece thickness at the outlet position of the first roughing stage, and a mean workpiece temperature in the second finishing stage; giving to said crown model formula a target crown value with regard to the workpiece being ejected from the second finishing stage, thereby obtaining relationship between the mean workpiece temperature and the workpiece thickness of the workpiece at the outlet position of the first roughing stage to attain said target crown value; obtaining a workpiece targer temperature at the inlet position of the second finishing stage from the mean workpiece temperature calculated out from the crown model formula; and controlling the workpiece temperature at the inlet position of the second finishing stage to said target temperature obtained in the preceding step.

2. The method as defined in claim 1, further comprising: changing constants in the crown model formula in correspondence with at least one of the changes of said workpiece material, said workpiece width, said predetermined product thickness rolls initial curves, load distribution among stands, total reaction force and another adjustment of the second finishing stage.

3. The method as defined in claim 1, further comprising: obtaining, with respect to the maximum and minimum allowable rolling speeds of the second finishing stage, workpiece temperature characteristics at the inlet position of the second finishing stage for the workpiece thickness at the outlet position of the first roughing stage; obtaining from said temperature characteristics and allowable range of the workpiece temperature at the inlet position of the second finishing stage; and adjusting the workpiece thickness at the outlet position of the first roughing stage in such a manner than the workpiece temperature at the inlet position of the second finishing stage is maintained within said allowable range.

4. The method as defined in claim 3, wherein said workpiece thickness at the outlet position of the first roughing stage is so established that the rolling speed is settable to a high value.

5. The method as defined in claim 1, wherein said thickness of the workpiece at the outlet of the first roughing stage is so established that the workpiece completely rolled to be a product with no chapping on the obverse and reverse surfaces of the workpiece.

* * * * *

UNITED STATES PATENT OFFICE

CERTIFICATE OF CORRECTION

Patent No. 3,958,435 Dated May 25, 1976

Inventor(s) Yoshio Inoi Et Al

It is certified that error appears in the above-identified patent and that said Letters Patent are hereby corrected as shown below:

Column 5, line 6, "HV and" should read --H, V and--.

Column 5, line 67, "operation" should read --operating--.

Column 6, line 60, "detector is" should read --detector 20 is--.

Column 8, line 17, "abovedescribed" should read --above-described--.

Column 8, line 38, "targar" should read --target--.

Signed and Sealed this

Seventh Day of December 1976

[SEAL]

*Attest:*

RUTH C. MASON
*Attesting Officer*

C. MARSHALL DANN
*Commissioner of Patents and Trademarks*